US009254515B2

(12) United States Patent
Breen et al.

(10) Patent No.: US 9,254,515 B2
(45) **Date of Patent: *Feb. 9, 2016**

(54) GUIDED KEEPER AND METHOD FOR METAL FORMING DIES

(71) Applicant: Standard Lifters, Inc., Grand Rapids, MI (US)

(72) Inventors: Scott M. Breen, Marne, MI (US); Joel T. Pyper, Grand Rapids, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/532,358

(22) Filed: Nov. 4, 2014

(65) Prior Publication Data

US 2015/0068269 A1 Mar. 12, 2015

Related U.S. Application Data

(63) Continuation of application No. 13/225,971, filed on Sep. 6, 2011, now Pat. No. 8,910,502.

(60) Provisional application No. 61/380,500, filed on Sep. 7, 2010.

(51) Int. Cl.

| | |
|---|---|
| ***B21D 37/12*** | (2006.01) |
| ***B21D 37/10*** | (2006.01) |
| ***B21D 37/04*** | (2006.01) |

(52) U.S. Cl.

CPC ..... *B21D 37/12* (2013.01); *B21D 37/04* (2013.01); *B21D 37/10* (2013.01); *Y10T 29/49963* (2015.01)

(58) Field of Classification Search

CPC ..... B21D 37/10; B21D 37/12; B21D 37/04; Y10T 29/49963

See application file for complete search history.

(56) References Cited

U.S. PATENT DOCUMENTS

| | | | |
|---|---|---|---|
| 2,346,297 | A | 4/1944 | Garbe |
| 2,487,233 | A | 11/1949 | Gerke |
| 2,627,313 | A | 2/1953 | Marsilius |
| 2,629,615 | A | 2/1953 | Marsilius |
| 2,663,180 | A | 12/1953 | Benedict |
| 2,979,004 | A | 4/1961 | Kenville et al. |
| 3,386,781 | A | 6/1968 | Blazek et al. |
| 3,474,656 | A | 10/1969 | Kraft |
| 3,514,166 | A | 5/1970 | Coley |
| 3,568,555 | A | 3/1971 | Stroh |
| 3,664,258 | A | 5/1972 | Vecchi |
| 3,730,039 | A | 5/1973 | Fedrigo |
| 3,897,118 | A | 7/1975 | Wolfthal |
| 4,003,283 | A | 1/1977 | Janiszewski |

(Continued)

*Primary Examiner* — Teresa M Ekiert
(74) *Attorney, Agent, or Firm* — Price Heneveld LLP

(57) ABSTRACT

A locking collar assembly for metal forming dies includes a disc-shaped locking collar with a cylindrical outer surface closely received in a collar bore in one face of a first die member. A circular recess in the outer face of the locking collar has an internal retainer ring groove. A counterbored shaped fastener hole extends through the collar and a part of the recess, and has shank, head and shoulder portions. A socket head cap screw is inserted in the fastener hole with a threaded end anchored in a threaded end aperture in one of the guide pins, with the head seated on the shoulder of the fastener hole. A retainer ring is mounted in the collar ring groove and overlies the cap screw head to positively prevent the cap screw from unintentionally unfastening from the guide pin.

29 Claims, 4 Drawing Sheets

(56) References Cited

U.S. PATENT DOCUMENTS

| | | | |
|---|---|---|---|
| 4,080,819 | A | 3/1978 | Hook et al. |
| 4,135,770 | A | 1/1979 | Doherty et al. |
| 4,199,313 | A | 4/1980 | Bohnenberger |
| 4,282,736 | A | 8/1981 | Mashburn |
| 4,326,402 | A | 4/1982 | Wallis |
| 4,483,173 | A | 11/1984 | Duhamel |
| 4,696,180 | A | 9/1987 | Zandel |
| 4,732,033 | A | 3/1988 | Smedberg et al. |
| 4,742,746 | A | 5/1988 | Olsson |
| 4,765,227 | A | 8/1988 | Balazs et al. |
| 4,796,460 | A | 1/1989 | Smedberg et al. |
| 4,836,071 | A | 6/1989 | Ersoy |
| 5,113,736 | A | 5/1992 | Meyerle |
| 5,243,743 | A | 9/1993 | Peterson |
| 5,245,904 | A | 9/1993 | Meyerle |
| 5,722,280 | A | 3/1998 | Bodnar |
| 5,775,212 | A | 7/1998 | Takao |
| 5,788,903 | A | 8/1998 | Allgaier |
| 5,974,852 | A | 11/1999 | Nieschulz |
| 6,408,728 | B1 | 6/2002 | Tsuji et al. |
| 6,848,290 | B2 | 2/2005 | Pyper et al. |
| 6,895,797 | B2 | 5/2005 | Lowry et al. |
| 6,925,922 | B2 | 8/2005 | Manabe et al. |
| 6,986,273 | B2 | 1/2006 | Rager |
| 7,000,446 | B2 | 2/2006 | Nieschulz et al. |
| 7,004,007 | B2 | 2/2006 | Kruger et al. |
| 7,114,365 | B2 | 10/2006 | Rooney, Jr. et al. |
| 7,152,451 | B1 | 12/2006 | Cotter |
| 7,730,757 | B2 | 6/2010 | Pyper et al. |
| 7,861,569 | B2 | 1/2011 | Cotter et al. |
| 7,950,262 | B2 | 5/2011 | Pyper et al. |
| 2002/0124706 | A1 | 9/2002 | Mochizuki |
| 2007/0037434 | A1 | 2/2007 | Fedder et al. |
| 2009/0193865 | A1 | 8/2009 | Pyper et al. |

GUIDED KEEPER AND METHOD FOR METAL FORMING DIES

CROSS REFERENCE TO RELATED APPLICATION

Applicants hereby claim priority under the provisions of 35 U.S.C. §120, to related U.S. application Ser. No. 13/225,971, filed Sep. 6, 2011, now U.S. Pat. No. 8,910,502, which claimed priority benefits under 35 U.S.C. §119 to commonly assigned, related U.S. Provisional Application No. 61/380,500 filed Sep. 7, 2010, both of which are incorporated herein by reference.

BACKGROUND OF THE INVENTION

The present invention relates to metal forming dies, and in particular to a guided keeper assembly and associated method.

Metal forming dies, such as stamping dies and the like, are well-known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed, and individually installed in the die set. Current die making processes require carefully machined, precision holes and recesses in the die set for mounting the individual components, such that the same are quite labor intensive, and require substantial lead time to make, test, and set up in a stamping press. Consequently, such metal forming dies are very expensive to design, manufacture, and repair or modify.

A modular guided keeper with a locking collar which both precisely aligns the two die members and positively limits reciprocal travel therebetween would be clearly advantageous in simplifying metal forming die constructions and reducing the costs in designing, manufacturing, and repairing the same. Positive retention of the guide pins and retention screws in the associated die member is important to ensure that the same do not loosen and cause damage to the die set and/or press, which would result in expensive repair and machine downtime.

SUMMARY OF THE INVENTION

One aspect of the present invention is a metal forming die of the type having a plurality of die pins interconnecting first and second die members for reciprocation between converged and diverged positions, which includes a locking collar assembly. The locking collar assembly has a cylindrically shaped blind collar bore disposed in a first face of the first die member, and a circularly shaped support surface disposed on a second face of the first die member at a location generally opposite and aligned with the collar bore and configured to support one end of one of the guide pins thereon. A locking collar includes a disc-shaped collar body with opposed, circularly shaped inner and outer faces, an axially extending central axis, and a cylindrical outside surface closely received in the collar bore in the first face of the first die member. The collar body includes a circular recess disposed in the outer face thereof in a concentric relationship therewith and defining an axially oriented inner side wall. An internal retainer ring groove is disposed in the side wall of the collar body, and is shaped to receive and detachably retain therein an associated retainer ring. At least one fastener clearance hole extends axially through the collar body and at least a portion of the circular recess at a location spaced radially offset from the central axis of the collar body and oriented parallel therewith. The fastener clearance hole has a counterbored shape with the shank portion disposed adjacent the inner face of the collar body, an enlarged head portion disposed adjacent the outer face of the collar body, and an annular shoulder portion disposed between the shank portion and the head portion. A socket head cap screw has a threaded shank portion extending through the shank portion of the fastener clearance hole in the collar body and is detachably received and securely retained in a threaded end aperture in the one guide pin, and a cylindrically shaped head portion with an exterior end face, an interior end face abutting against and securely seated on the shoulder portion of the fastener clearance hole, and an outside peripheral surface received in the head portion of the fastener clearance hole in the collar body. A retainer ring is detachably received and securely retained in the retainer ring groove in the collar body, and has an interior face disposed over at least a portion of the exterior end face of the head portion of the cap screw, whereby engagement between the exterior end face of the head portion of the cap screw and the interior face of the retaining ring positively prevents the cap screw from unintentionally unfastening from the end aperture in the one guide pin.

Another aspect of the present invention is a guided keeper assembly for metal forming dies of the type having first and second die members mounted a spaced apart distance for reciprocation between converged and diverged positions. The guided keeper assembly includes a base having a mounting face shaped to abut an adjacent face of the first die member, and a central aperture extending axially through a central portion of the base. The guided keeper also includes a guide pin having a cylindrically shaped central portion closely received in the central aperture of the base for precisely guiding reciprocal motion between the first and second die members, a first end having an enlarged head shaped to abut the base to positively limit travel between the first and second die members, and a second end positioned opposite the first end and having a shoulder with at least a portion thereof shaped for close reception in a guide pin bore in a first face of the second die member to precisely locate the second end of the guide pin in the second die member, and including a threaded end aperture extending axially into the shoulder. The guided keeper also includes a first fastener securely, yet detachably connecting the base with the first die member, and a locking collar securely, yet detachably connecting the second end of the guide pin with the second die member. The locking collar includes a disc-shaped collar body with opposed, circularly shaped inner and outer faces, an axially extending central axis, and a cylindrical outside surface shaped for close reception in a cylindrical collar bore disposed in a second face of the second die member generally opposite the guide pin bore. A circular recess is disposed in the outer face of the collar body in a concentric relationship therewith, and defines an axially oriented inner side wall. An internal retainer ring groove is disposed in the side wall of the collar body, and is shaped to receive and detachably retain therein an associated retainer ring. At least one fastener clearance hole extends axially through the collar body and at least a portion of the circular recess at a location spaced radially offset from the central axis of the collar body and is oriented parallel therewith. The fastener clearance hole has a counterbored shape with a shank portion disposed adjacent the inner face of the collar body, an enlarged head portion disposed adjacent the outer face of the collar body, and an annular shoulder portion disposed between the shank portion and the head portion. A socket head cap screw has a threaded shank portion extending through the shank portion of the fastener clearance hole in the collar body and detachably received and securely retained in the threaded end aperture in the guide pin, and a cylindrically shaped head portion with an exterior end face, an interior end face abutting against and securely seated on the shoulder portion fastener clearance hole, and an outside peripheral surface received in the head portion of the fastener clearance hole in the collar body. A retainer ring is detachably received and securely retained in the retainer ring groove in the collar body, and has an interior face disposed over at least a portion of the exterior end face of the head portion of the cap screw, whereby engagement between the exterior end face of the head portion of the cap screw and the interior face of the retaining ring positively prevents the cap screw from unintentionally unfastening from the end aperture in the guide pin.

Yet another aspect of the present invention is a locking collar assembly for metal forming dies of the type having a plurality of guide pins interconnecting first and second die members for reciprocation between converged and diverged positions. The locking collar assembly includes a locking collar having a disc-shaped collar body with opposed, circularly shaped inner and outer faces, an axially extending central axis, and a cylindrical outside surface shaped for close reception in a cylindrical collar bore disposed in a first space of the first die member. A circular recess is disposed in the outer face of the collar body in a concentric relationship therewith and defines an axially oriented inner side wall. An internal retainer ring groove is disposed in the side wall of the collar body and is shaped to receive and detachably retain therein an associated retainer ring. At least one fastener clearance hole extends axially through the collar body and at least a portion of the circular recess at a location spaced radially offset from the central axis of the collar body and is oriented parallel therewith. The fastener clearance hole has a counterbored shape with a shank portion disposed adjacent an inner face of the collar body, an enlarged head portion disposed adjacent the outer face of the collar body, and an annular shoulder portion disposed between the shank portion and the head portion. A socket head cap screw has a threaded shank portion extending through the shank portion of the fastener clearance hole in the collar body and is detachably received and securely retained in a threaded end aperture in an associated one of the guide pins positioned on a second face of the first die member generally opposite the collar bore, and a cylindrically shaped head portion with an exterior end face, an interior end face abutting against and securely seated on the shoulder portion of the fastener clearance hole, and an outside peripheral surface received in the head portion of the fastener clearance hole in the collar body. A retainer ring is detachably received and securely retained in the retainer ring groove in the collar body, and has an interior face disposed over at least a portion of the exterior end face of the head portion of the cap screw, whereby engagement between the exterior end face of the head portion of the cap screw and the interior face of the retaining ring positively prevents the cap screw from unintentionally unfastening from the end aperture in the one guide pin.

Yet another aspect of the present invention is a method for making metal forming dies of the type having a plurality of guide pins interconnecting first and second die members for reciprocation between converged and diverged positions. The method includes forming a cylindrically shaped blind collar bore in a first face of the first die member, and providing a circularly shaped support surface on a second face of the first die member at a location generally opposite and aligned with the collar bore, and configured to support one end of one of the guide pins thereon. The method also includes forming a disc-shaped collar body with opposed, circularly shaped inner and outer faces, an axially extending central axis, and a cylindrical outside surface shaped for close reception in the collar bore in the first face of the first die member. The method also includes the steps of forming a circular recess in the outer face of the collar body in a concentric relationship therewith to define an axially oriented inner side wall in the collar body, and forming an internal retainer ring groove in the side wall of the collar body shaped to receive and detachably retain therein an associated retainer ring. The method also includes the step of forming at least one fastener clearance hole axially through the collar body and at least a portion of the circular recess at a location spaced radially offset from the central axis of the collar body and oriented parallel therewith. The fastener clearance hole has a counterbored shape with a shank portion disposed adjacent the inner face of the collar body, an enlarged head portion disposed adjacent the outer face of the collar body, and an annular shoulder portion disposed between the shank portion and the head portion. The method further includes the steps of providing a socket head cap screw with a threaded shank portion and a cylindrically shaped head portion with an exterior end face, an interior end face, and an outside peripheral surface shaped for close reception in the head portion of the fastener clearance hole in the collar body. The method further includes the step of inserting the socket head cap screw into the fastener clearance hole in the collar body with the threaded shank portion extending through the shank portion of the fastener clearance hole in the collar body and being detachably received and securely retained in a threaded end aperture in the one guide pin by fully tightening the socket head screw, and with the interior end face of the head portion abutting against and securely seating on the shoulder portion of the fastener clearance hole, and the outside peripheral surface being received in the head portion of the fastener clearance hole in the collar body. The method further includes the steps of providing a retainer ring shaped for reception in the retainer ring groove in the collar body, and having an interior face, and inserting the retainer ring in the retainer ring groove of the collar body with at least a portion of the retainer ring positioned over the exterior end face of the head portion of the cap screw, whereby engagement between the exterior end face of the head portion of the cap screw and the interior face of the retaining ring positively prevents the cap screw from unintentionally unfastening from the end aperture in the one guide pin.

Yet another aspect of the present invention is a locking collar for a guided keeper assembly, which positively prevents the screws from loosening and falling out of the tool during operation. Preferably, the retainer ring groove is tapered, such that when the retaining ring is installed, the taper provides locking force to the screw heads assuring that the screws are properly seated. The collar provides greater support for the guide pin, particularly when used in die members made of cast material. When the collar is installed into a tool, an integral O-ring maintains the radial location of the same and prevents the collar from falling out, which aids in tool removal and reassembly. Machining of the die member and/or tool is simple and requires no specialized tooling. The locking collar can be machined from one piece of bar stock material on an automatic CNC lathe for single setup processing, which reduces manufacturing time and cost. No additional machining process is required to the locking collar after surface treatment and/or assembly. The locking collar and related guided keeper assembly are efficient in use, economical to manufacture, capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
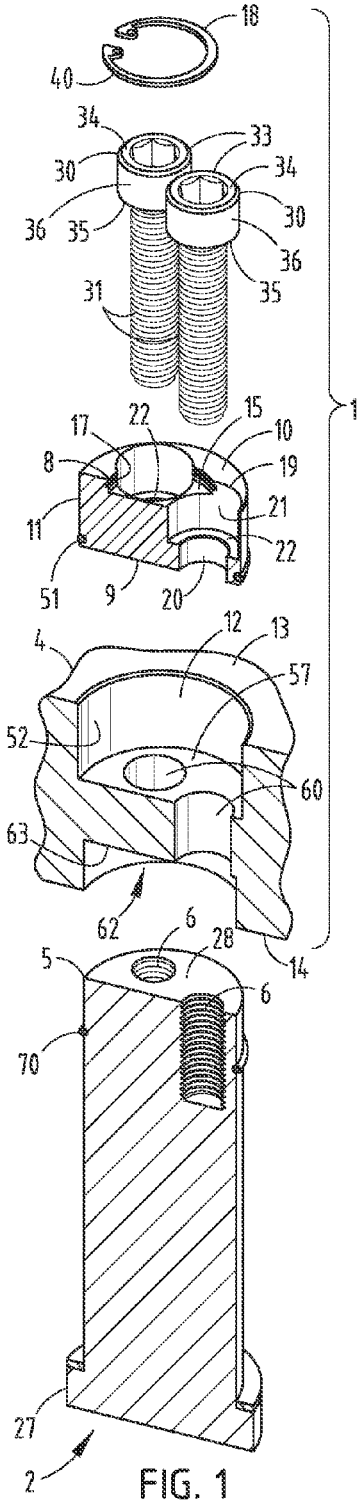
FIG. 1 is an exploded perspective view of a locking collar and related portions of a guided keeper assembly embodying the present invention.
Figure 2:
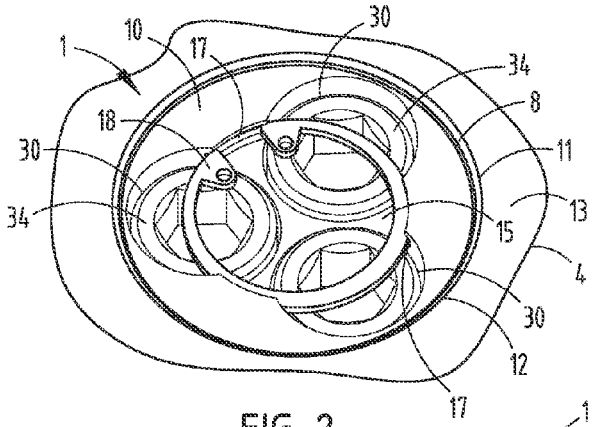
FIG. 2 is a perspective view of the locking collar, taken from an outer portion thereof.
Figure 3:
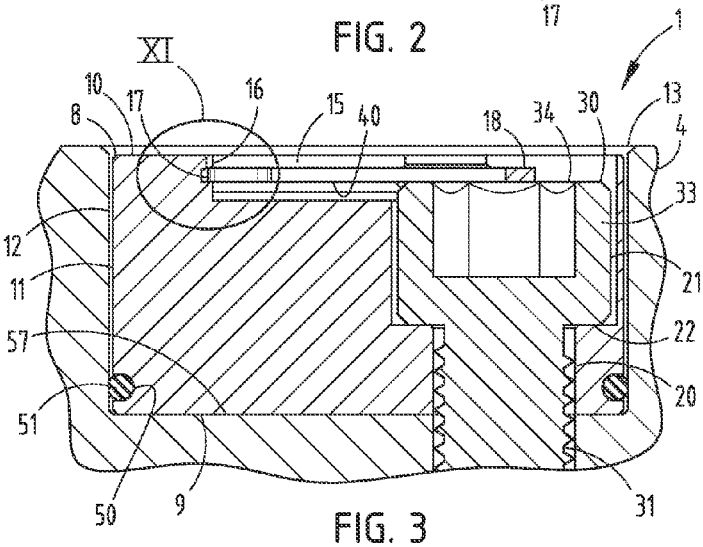
FIG. 3 is a cross-sectional view of the locking collar, shown installed in an associated die member.
Figure 4:
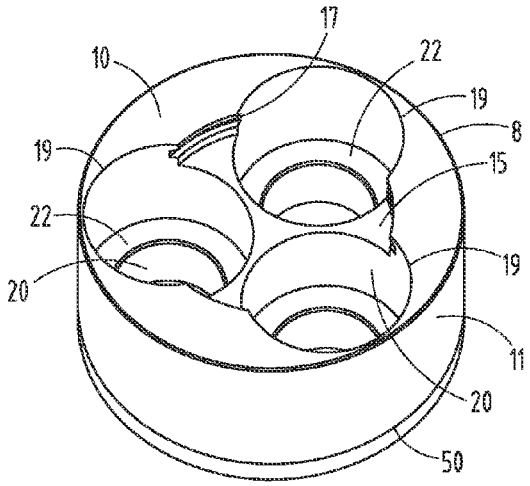
FIG. 4 is a perspective view of a collar body portion of the locking collar.
Figure 5:
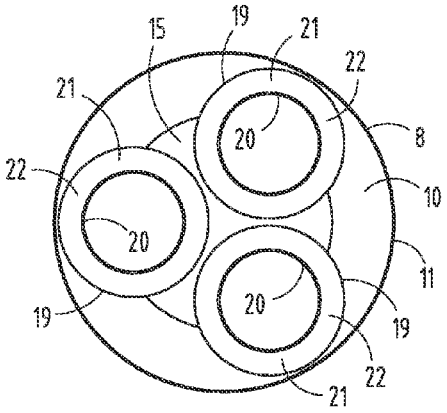
FIG. 5 is a top plan view of the collar body.
Figure 6:
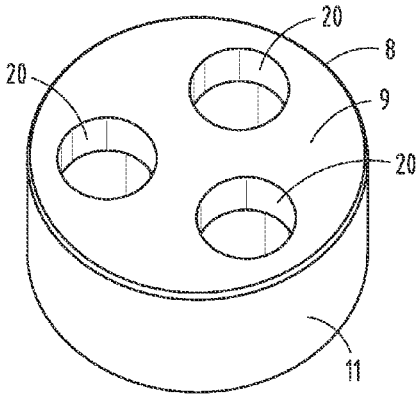
FIG. 6 is a perspective view of the collar body, taken from an inner face thereof.

For purposes of description herein, the terms "upper," "lower," "right," "left," "rear," "front," "vertical," "horizontal," and derivatives thereof shall relate to the invention as oriented in FIGS. 1-3. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 20:
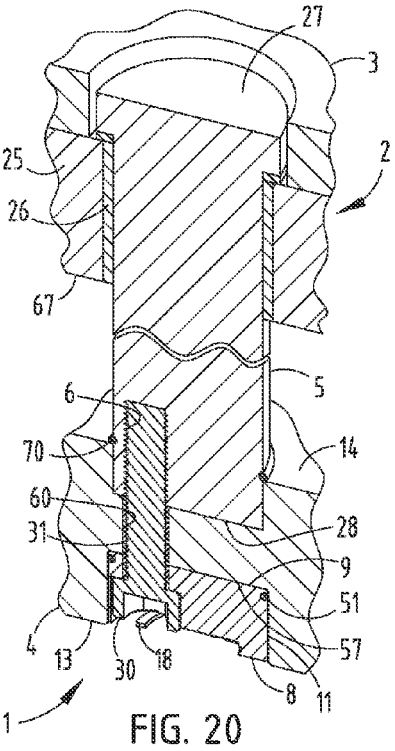
FIG. 20 is a cross-sectional perspective view of the guided keeper assembly and locking collar, shown fully installed in first and second die members, and taken from an orientation, opposite that of FIGS. 16-19.

The reference number 1 (FIGS. 1-4) generally designates a locking collar for use in conjunction with a guided keeper assembly 2 of the type used in the construction of metal forming dies having first and second die members 3, 4 mounted a spaced apart distance for reciprocation between converged and diverged positions. The term "die member," as used herein, generically refers to either a stationary die member, such as die shoe 3, or a reciprocating die member, such as die pad 4. In the embodiment illustrated in FIG. 20, locking collar 1 is shown mounted in reciprocating die pad 4, which is located below the stationary die shoe 3. In the embodiment illustrated in FIG. 1, locking collar 1 is mounted in the reciprocating die pad 4, which is located above a stationary die shoe 3. As is understood by those skilled in the art, the present locking collar 1 and associated guided keeper assembly 2 can be mounted in either die member 3, 4, depending on the requirements of the specific application.

Locking collar 1 has a disc-shaped collar body 8 with opposed, circularly shaped inner and outer faces 9 and 10, respectively, an axially extending central axis, and a cylindrical outside surface 11 shaped for close reception in a cylindrical collar bore 12 disposed in a first face 13 of die pad 4. A circular recess 15 is disposed in the outer face 10 of collar body 8 in a concentric relationship therewith, and defines axially oriented inner side wall 16. An internal retainer ring groove 17 is disposed in the side wall 16 of collar body 8, and is shaped to receive and detachably retain therein an associated retainer ring 18. At least one fastener clearance hole 19 extends axially through collar body 8 and at least a portion of circular recess 15 at a location spaced radially offset from the central axis of collar body 8 and is oriented parallel therewith. Fastener clearance hole 19 has a counterbored shape with a shank portion 20 disposed adjacent the inner face 9 of collar body 8, an enlarged head portion 21 disposed adjacent the outer face 10 of collar body 8, and an annular shoulder portion 22 disposed between shank portion 20 and head portion 21. A socket head cap screw 30 has a threaded shank portion 31 extending through the shank portion 20 of fastener clearance hole 19 in collar body 8, and is detachably received and securely retained in a threaded end aperture 6 in an associated one of the guide pins 5 positioned on the second face 14 of die pad 4, generally opposite the collar bore 8. Cap screw 30 also has a cylindrically shaped head portion 33 with an exterior end face 34, an interior end face 35 abutting against and securely seated on the shoulder portion 22 of fastener clearance hole 19, and an outside peripheral surface 36 received in the head portion 21 of fastener clearance hole 19 in collar body 8. Retainer ring 18 is detachably received and securely retained in the retainer ring groove 17 in collar body 8, and has an interior face 40 disposed over at least a portion of the exterior end face 34 of the head portion 33 of cap screw 30, such that engagement between the exterior end face 34 of the head portion 33 of cap screw 30, and the interior face 40 of retaining ring 18 positively prevents cap screw 30 from unintentionally unfastening from the end aperture 32 in guide pin 5.

The illustrated guided keeper assembly 2 in which locking collar 1 is assembled has a unique modular construction, such as that disclosed in U.S. Pat. No. 7,730,757, and includes a base 25 (FIG. 20) which is shown mounted on stationary die shoe 3, having a bushing retained in a central aperture of base 25 in which guide pin 5 is closely received for sliding reciprocation. Guide pin 5 has an enlarged head 25 at one end which abuts base 25 to positively limit travel between die shoe 3 and die pad 4, and an opposite end with a shoulder 28 which is mounted on die pad 4 to precisely locate the same thereon.

Figure 7:
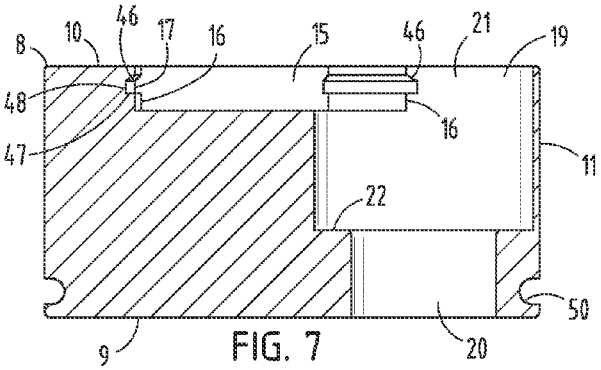
FIG. 7 is a cross-sectional view of the collar body.
Figure 8:
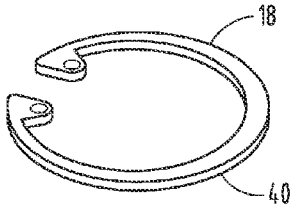
FIG. 8 is a perspective view of a retainer ring portion of the locking collar.
Figure 9:
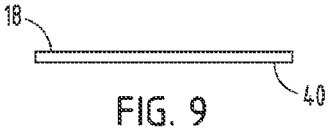
FIG. 9 is a side elevational view of the retainer ring.
Figure 10:
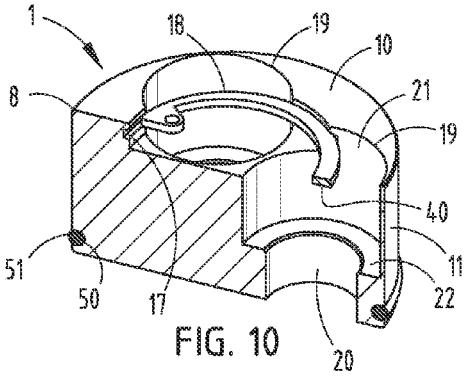
FIG. 10 is a cross-sectional perspective view of the collar body, with the retainer ring installed therein.

The illustrated collar body 8 has three fastener clearance holes 19, each being spaced radially offset from the central axis of collar body 8, and arranged in a circumferentially spaced apart relationship on collar body 8. Three cap screws 30 are used to attach collar body 8 to the associated die pad 4 in the manner illustrated in FIGS. 1-3. The offset location of fastener clearance holes 19 and cap screws 30 prevents the guide pin 5 from rotating axially relative to die pad 4. The illustrated collar body 8 also includes an external O-ring groove 50, which as best illustrated in FIGS. 3, 7, and 10, is located in the cylindrical outside surface 11 of collar body 8 at a location axially adjacent to the inner face 9 of collar body 8. A flexible O-ring 51 has a radially interior portion thereof shaped for close reception in O-ring groove 50 in collar body 8, and a radially exterior portion thereof shaped for resilient contact with the side wall 52 of the collar bore 12 in die pad 4, so as to selectively retain collar body 8 in place in the die pad 4 to facilitate installation and removal of the locking collar 1 from the die pad 4. O-ring 51 maintains the radial location of collar body 8 within collar bore 12, which aids in removal and assembly of cap screw 30.

Figure 11:
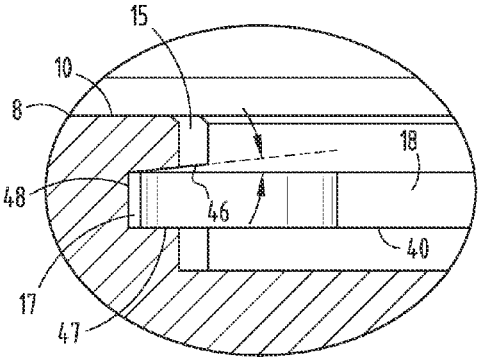
FIG. 11 is an enlarged fragmentary cross-sectional view of the retainer ring shown installed in a retainer ring groove portion of the collar body.
Figure 12:
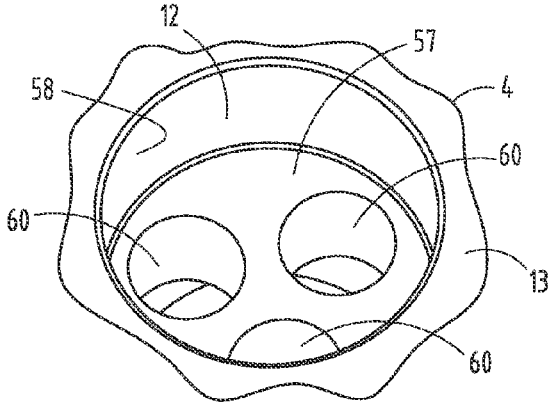
FIG. 12 is a perspective view of a first face of a first die member which has been machined for reception of the locking collar therein.
Figure 13:
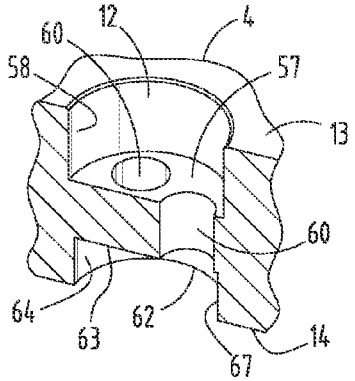
FIG. 13 is a fragmentary cross-sectional perspective view of the first die member.
Figure 14:
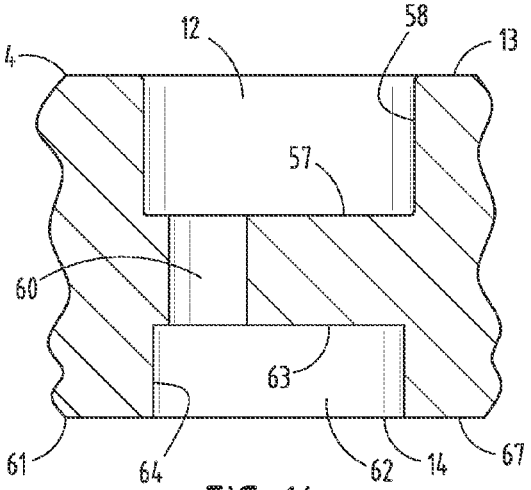
FIG. 14 is a fragmentary cross-sectional view of the first die member.
Figure 15:
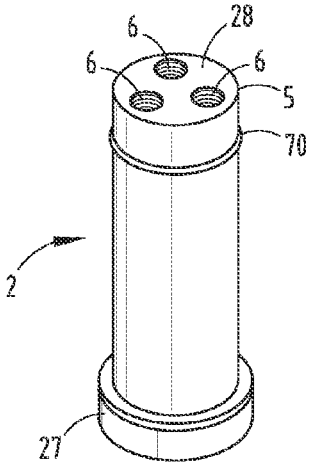
FIG. 15 is a perspective view of a guide pin portion of the guided keeper assembly embodying the present invention.

With reference to FIGS. 3, 7, and 11, the retainer groove 17 in the illustrated collar body 8 has a generally U-shaped construction defined by an outer surface 46, an opposite inner surface 47, and an end surface 48. Preferably, outer surface 46 is tapered outwardly from inner surface 47, as shown by the arrows and broken line in FIG. 11, such that when retainer ring 18 is installed in retainer ring groove 17, the tapered outer surface 46 resiliently urges the interior face 40 of retainer ring 18 abuttingly against the exterior end faces 34 of the head portions 33 of cap screws 30. This resilient force generated by retainer ring 18 and associated retainer ring groove 17 provides a locking force against the head portions 33 of each of the cap screws 30, which securely and positively retains cap screws 30 in place.

Locking collar 1 not only serves to positively retain cap screws 30 in place and prevent the same from unintentionally unfastening from the end apertures 6 in guide pin 5, collar body 8 also serves to distribute the forces applied by the cap screws 30 generally uniformly across the entire bottom or base 63 of collar bore 12 for improved support of the guide pin 5 on die pad 4. More specifically, the inner face 9 of collar body 8 has a diameter that is substantially greater than the diameter of the shank portion 20 of a fastener clearance hole 19, such that the inner face 9 of collar body 8 distributes the forces applied by the cap screws 30 generally uniformly across the entire bottom 63 of the collar bore 12, which is particularly beneficial when die pad 4 is constructed from a cast material, such as cast iron or the like.

The illustrated retainer ring 18, as best illustrated in FIGS. 1-3 and 8-11 comprises a split snap ring, having a generally conventional construction with apertured end ears shaped for interface with an associated tool to insert and remove retainer ring 18 from retainer ring groove 17 in collar body 8.

Figure 16:
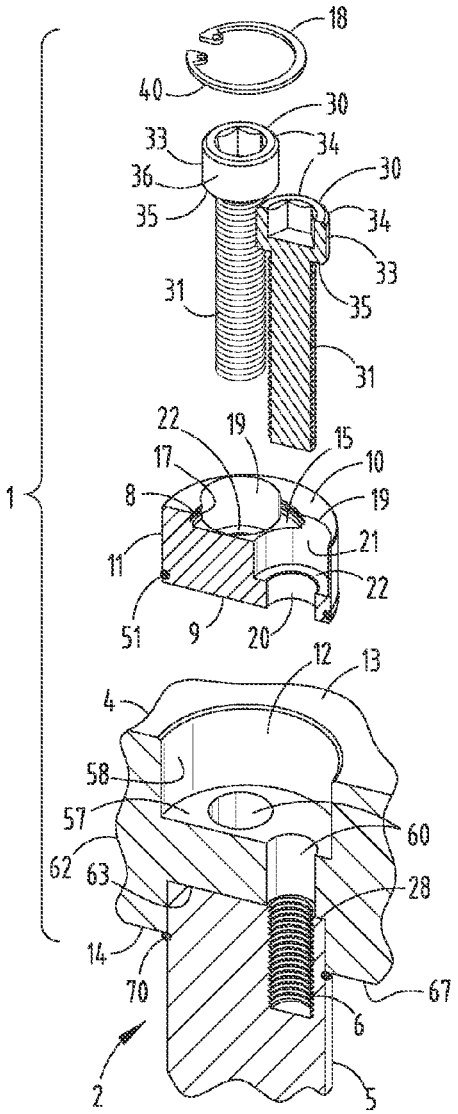
FIG. 16 is an exploded perspective view of the locking collar, shown with one end of the guide pin assembled in the first die member.
Figure 17:
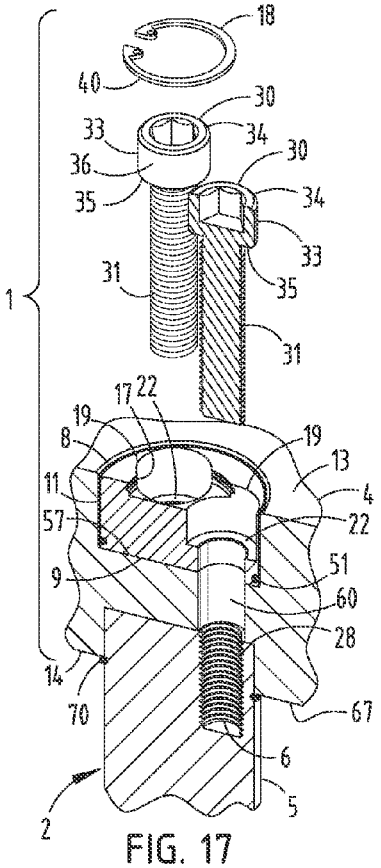
FIG. 17 is an exploded cross-sectional perspective view of the locking collar, shown in FIG. 16, with the collar body inserted into an associated collar bore in the first die member.
Figure 18:
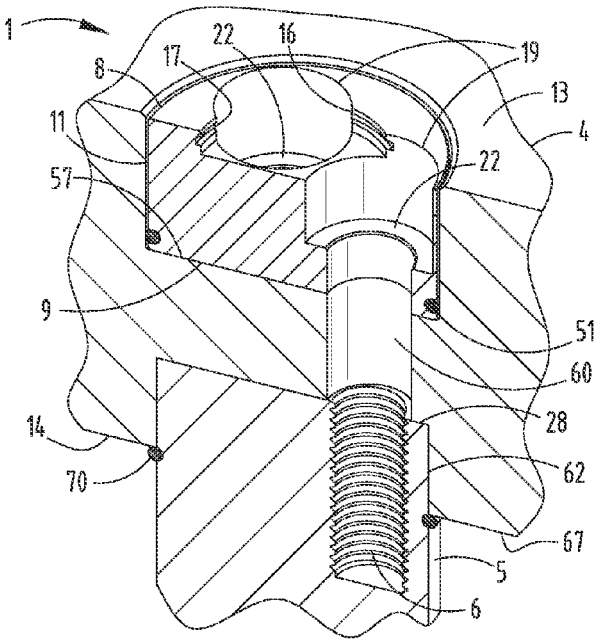
FIG. 18 is a cross-sectional perspective view of the locking collar shown partially installed in the first die member.
Figure 19:
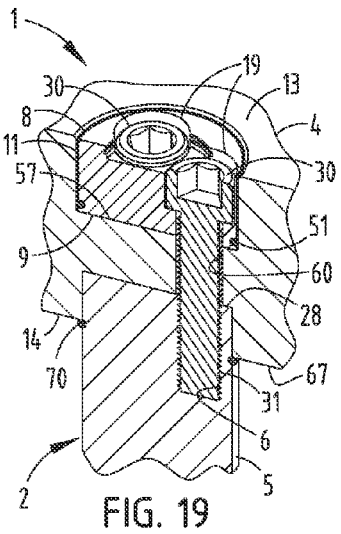
FIG. 19 is a cross-sectional perspective view of the locking collar shown partially installed in the first die member.
Figure 21:
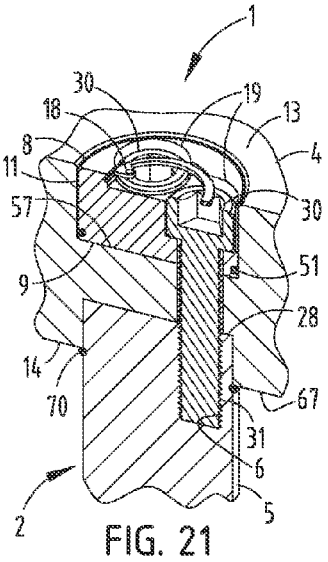
FIG. 21 is a cross-sectional perspective view of the guided keeper assembly and locking collar, shown fully installed in the first die member.

As best illustrated in FIGS. 12-21, locking collar 1 may be mounted in die pad 4 in the following manner. Collar bore 12 is formed in the upper surface of die pad 4 (as oriented in FIGS. 12-14) by simple machining, and is shaped to closely receive therein collar body 8. The illustrated collar bore 12 is cylindrical in shape, and defined by a flat base 57 and circular sidewall 58. Three non-threaded fastener apertures 60 are formed through the base 57 of collar bore 12, each being spaced radially offset from the central axis of the collar bore, and arranged in a circumferentially spaced apart relationship that is identical with the spacing of fastener clearance holes 19 in collar body 8. A circularly shaped support surface is provided on the second face 14 of die pad 4 at a location generally opposite and aligned with collar bore 12, and is configured to support one end of an associated one of the guide pins 5 thereon. In the illustrated example, a guide pin bore 62, defined by flat base 63 and circular sidewall 64, is formed in the second face 67 of die pad 4, and is shaped to closely receive therein the shoulder end 28 of guide pin 5. The base portion 63 of guide pin bore 62 defines the support surface for guide pin shoulder 28, and also precisely locates the guide pin 5 on die pad 4. As best illustrated in FIG. 16, the shouldered end 28 of guide pin 5 is then inserted into guide pin bore 62 in die pad 4. An O-ring 70 mounted adjacent the shouldered end of guide pin 5 abuts against the lower face 67 of die pad 4. Next, collar body 8 is inserted into collar bore 12 in die pad 4 and oriented such that fastener clearance holes 19 are accurately aligned with the fastener apertures 60 in die pad 4, as shown in FIG. 17. Next, three cap screws 30 are inserted into and through the fastener clearance holes 19 in collar body 8, and tightened in place with the threaded shank portions 31 of cap screws 30 securely anchored in the threaded end apertures 6 in the shouldered end 28 of guide pin 5, as shown in FIG. 19. Next, retainer ring 18 is installed in the retainer ring groove 17 in collar body 8, as shown in FIG. 21, such that the interior face 40 of retainer ring 18 is disposed closely over at least a portion of the exterior ends 34 of the head portions 33 of cap screws 30, as best shown in FIG. 3, so as to positively prevent the cap screws from unintentionally unfastening from the end apertures in guide pins 5. The tapered outer surface 46 of retainer ring groove 17 in collar body 8 resiliently urges the interior face 40 of retainer ring 18 abuttingly against the exterior end faces 34 of the head portions 33 of cap screws 30.

As will be appreciated by those skilled in the art, the locator end 27 of guide pin 22 can be attached to die pad 4 using a variety of different fastening techniques, including those which do not require recess 62, such that pin shoulder 27 is abuttingly supported directly on the flat face of die pad 4. Dowels and/or other locating mechanisms, including fixed and removable center posts or pins, such as those disclosed in U.S. Pat. No. 7,730,757, may be employed to insure proper alignment between guide pin 22 and die pad 4.

Locking collar 1 can be quickly and easily removed from die pad 4 by simply reversing the step sequence outlined above.

The collar body 8 of locking collar 1 can be efficiently manufactured from a single piece of solid bar stock material. A length or section of bar stock material is placed into an automatic CNC lathe or other similar machine device that is centered in a single setup operation. The recess 15, retainer ring groove 17, fastener clearance holes 19, and O-ring groove 50 are all formed in the bar stock during the single setup operation. Consequently, tolerances can be held tighter because of the single setup operation, and economy of manufacturing cost is realized. After the collar body 8 is formed, it can be surface coated if necessary.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a metal forming die of the type having a plurality of guide pins interconnecting first and second die members for reciprocation between converged and diverged positions, the improvement of a locking collar assembly, comprising:

a cylindrically shaped collar bore disposed in a first face of said first die member;

a circularly shaped support surface disposed on a second face of said first die member at a location generally opposite and aligned with said collar bore, and configured to support one end of one of said guide pins thereon;

a disc-shaped collar body with opposed, circularly shaped inner and outer faces, an axially extending central axis, and a cylindrical outside surface closely received in said collar bore in said first face of said first die member, and including:

a circular recess disposed in said outer face of said collar body in a concentric relationship therewith, and defining an axially oriented inner side wall;

an internal retainer ring groove disposed in said side wall of said collar body, and shaped to receive and detachably retain therein an associated retainer ring;

at least one fastener clearance hole extending axially through said collar body and at least a portion of said circular recess at a location spaced radially offset from said central axis of said collar body and oriented parallel therewith;

said fastener clearance hole having a counterbored shape with a shank portion disposed adjacent said inner face of said collar body, an enlarged head portion disposed adjacent said outer face of said collar body, and an annular shoulder portion disposed between said shank portion and said head portion;

a socket head cap screw having a threaded shank portion extending through said shank portion of said fastener clearance hole in said collar body and detachably received and securely retained in a threaded end aperture in said one guide pin, and a cylindrically shaped head portion with an exterior end face, an interior end face abutting against and securely seated on said shoulder portion of said fastener clearance hole, and an outside peripheral surface received in said head portion of said fastener clearance hole in said collar body; and a retainer ring detachably received and securely retained in said retainer ring groove in said collar body, and having an interior face disposed over at least a portion of said exterior end face of said head portion of said cap screw, whereby engagement between said exterior end face of said head portion of said cap screw and said interior face of said retainer ring positively prevents said cap screw from unintentionally unfastening from said end aperture in said one guide pin.

2. A metal forming die as set forth in claim 1, wherein:

said collar bore comprises a blind bore.

3. A metal forming die as set forth in claim 1, wherein the first die member is constructed from a cast material.

4. A metal forming die as set forth in claim 3, wherein the first die member is constructed from cast iron.

5. A metal forming die as set forth in claim 1, wherein the first die member is constructed from plate steel.

6. A metal forming die as set forth in claim 1, wherein:

said retainer ring groove in said collar body has a tapered outer surface which resiliently urges said interior face of said retainer ring abuttingly against said exterior end face of said head portion of said cap screw.

7. A metal forming die as set forth in claim 6, wherein:

said collar body includes an external O-ring groove disposed in said cylindrical outside surface thereof at a location axially adjacent to said inner face of said collar body; and including a flexible O-ring having a radially interior portion closely received in said O-ring groove in said collar body and a radially exterior portion resiliently contacting the side wall of said collar bore in said first die shoe to selectively retain said collar body in place in said first die member to facilitate installation and removal of said locking collar assembly from said first die member.

8. A metal forming die as set forth in claim 7, including:

a plurality of said fastener clearance holes located in said collar body, each being spaced radially offset from said central axis of said collar body, and being arranged in a circumferentially spaced apart relationship.

9. A metal forming die as set forth in claim 8, wherein:

said first die member comprises a reciprocating die pad.

10. A metal forming die as set forth in claim 9, including:

a cylindrically shaped guide pin bore disposed in said second face of said die pad at a location generally opposite and aligned with said collar bore, closely receiving at least a portion of said one end of said one said guide pin therein, and having a recessed base portion defining at least a portion of said support surface on which said one end of one guide pin is supported.

11. A metal forming die as set forth in claim 10, wherein:

said guide pin bore is shaped to telescopingly receive therein said one end of said one guide pin.

12. A metal forming die as set forth in claim 11, wherein:

said inner face of said collar body has a diameter substantially greater than the diameter of said shank portion of said fastener clearance hole, whereby said inner face of said collar body distributes the forces applied by said cap screw generally uniformly across said base surface of said collar bore for improved support of said one guide pin on said die pad.

13. A metal forming die as set forth in claim 12, wherein:

said retainer ring comprises a split snap ring.

14. A metal forming die as set forth in claim 13, wherein:

said collar body has a one-piece, integrally formed construction made from metal bar stock.

15. A metal forming die as set forth in claim 1, including:

a plurality of said fastener clearance holes located in said collar, each being spaced radially offset from said central axis of said collar body, and being arranged in a circumferentially spaced apart relationship.

16. A guided keeper assembly for metal forming dies of the type having first and second die members mounted a spaced apart distance for reciprocation between converged and diverged positions, comprising:

a base having a mounting face shaped to abut an adjacent face of the first die member, and a central aperture extending axially through a central portion of said base;

a guide pin having a cylindrically-shaped central portion closely received in said central aperture of said base for precisely guiding reciprocal motion between the first and second die members, a first end having an enlarged head shaped to abut said base to positively limit travel between the first and second die members, and a second end positioned opposite said first end and having a shoulder with at least a portion thereof shaped for close reception in a guide pin bore in a first face of the second die member to precisely locate said second end of said guide pin in the second die member, and including a threaded end aperture extending axially into said shoulder;

a first fastener securely, yet detachably, connecting said base with the first die member; and a locking collar securely, yet detachably, connecting said second end of said guide pin with the second die member, and including:

a disc-shaped collar body with opposed, circularly shaped inner and outer faces, an axially extending central axis, and a cylindrical outside surface shaped for close reception in a cylindrical collar bore disposed in a second face of the second die member generally opposite the guide pin bore;

a circular recess disposed in said outer face of said collar body in a concentric relationship therewith, and defining an axially oriented inner side wall;

at least one fastener clearance hole extending axially through said collar body and at least a portion of said circular recess at a location spaced radially offset from said central axis of said collar body and oriented parallel therewith; said fastener clearance hole having a counterbored shape with a shank portion disposed adjacent said inner face of said collar body, an enlarged head portion disposed adjacent said outer face of said collar body, and an annular shoulder portion disposed between said shank portion and said head portion;

a socket head cap screw having a threaded shank portion extending through said shank portion of said fastener clearance hole in said collar body and detachably received and securely retained in said threaded end aperture in said guide pin, and a cylindrically shaped head portion with an exterior end face, an interior end face abutting against and securely seated on said shoulder portion of said fastener clearance hole, and an outside peripheral surface received in said head portion of said fastener clearance hole in said collar body; and a retainer ring detachably received and securely retained on said collar body, and having an interior face disposed over at least a portion of said exterior end face of said head portion of said cap screw, whereby engagement between said exterior end face of said head portion of said cap screw and said interior face of said retainer ring positively prevents said cap screw from unintentionally unfastening from said end aperture in said guide pin.

17. A guided keeper assembly as set forth in claim 16, wherein the first die member is constructed from a cast material.

18. A guided keeper assembly as set forth in claim 17, wherein the first die member is constructed from cast iron.

19. A guided keeper assembly as set forth in claim 18, wherein the first die member is constructed from plate steel.

20. A guided keeper assembly as set forth in claim 19, wherein the second die member is constructed from a cast material.

21. A guided keeper assembly as set forth in claim 19, wherein the second die member is constructed from plate steel.

22. A locking collar assembly for metal forming dies of the type having a plurality of guide pins interconnecting first and second die members for reciprocation between converged and diverged positions, comprising:

a locking collar having:

a disc-shaped collar body with opposed, circularly shaped inner and outer faces, an axially extending central axis, and a cylindrical outside surface shaped for close reception in a cylindrical collar bore disposed in a first face of the first die member;

a circular recess disposed in said outer face of said collar body in a concentric relationship therewith, and defining an axially oriented inner side wall;

at least one fastener clearance hole extending axially through said collar body and at least a portion of said circular recess at a location spaced radially offset from said central axis of said collar body and oriented parallel therewith, said fastener clearance hole having a counterbored shape with a shank portion disposed adjacent said inner face of said collar body, an enlarged head portion disposed adjacent said outer face of said collar body, and an annular shoulder portion disposed between said shank portion and said head portion;

a socket head cap screw having a threaded shank portion extending through said shank portion of said fastener clearance hole in said collar body and detachably received and securely retained in a threaded end aperture in an associated one of the guide pins positioned on a second face of the first die member generally opposite the collar bore, and a cylindrically shaped head portion with an exterior end face, an interior end face abutting against and securely seated on said shoulder portion of said fastener clearance hole, and an outside peripheral surface received in said head portion of said fastener clearance hole in said collar body; and a retainer ring detachably received and securely retained on said collar body.

23. A locking collar assembly for metal forming dies as set forth in claim 22, wherein the first die member is constructed from a cast material.

24. A locking collar assembly for metal forming dies as set forth in claim 23, wherein the first die member is constructed from cast iron.

25. A locking collar assembly for metal forming dies as set forth in claim 22, wherein the first die member is constructed from plate steel.

26. A locking collar assembly for metal forming dies as set forth in claim 22, wherein the second die member is constructed from a cast material.

27. A locking collar assembly for metal forming dies as set forth in claim 26, wherein the second die member is constructed from cast iron.

28. A locking collar assembly for metal forming dies as set forth in claim 22, wherein the second die member is constructed from plate steel.

29. A locking collar assembly for metal forming dies as set forth in claim 22, wherein said retainer ring has an interior face disposed over at least a portion of said exterior end face of said head portion of said cap screw, whereby engagement between said exterior end face of said head portion of said cap screw and said interior face of said retainer ring positively prevents said cap screw from unintentionally unfastening from said end aperture in said one guide pin.

* * * * *